US008643575B2

(12) United States Patent
Kim

(10) Patent No.: US 8,643,575 B2
(45) Date of Patent: Feb. 4, 2014

(54) ORGANIC LIGHT EMITTING DISPLAY COMPRISING A SINK CURRENT GENERATOR THAT GENERATES AN INITIALIZATION CURRENT CORRESPONDING TO BIT VALUES OF INITIALIZATION DATA

(75) Inventor: Hyung-Soo Kim, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 911 days.

(21) Appl. No.: 12/217,665

(22) Filed: Jul. 7, 2008

(65) Prior Publication Data

US 2009/0135107 A1 May 28, 2009

(30) Foreign Application Priority Data

Nov. 23, 2007 (KR) ..... 10-2007-0120017

(51) Int. Cl.
*G09G 3/32* (2006.01)

(52) U.S. Cl.
USPC ..... 345/82; 345/76

(58) Field of Classification Search
USPC ..... 345/76–83
See application file for complete search history.

(56) References Cited

U.S. PATENT DOCUMENTS

| | | | | |
|---|---|---|---|---|
| 2004/0196239 | A1* | 10/2004 | Kwon | 345/92 |
| 2005/0017934 | A1* | 1/2005 | Chung et al. | 345/82 |
| 2005/0207249 | A1* | 9/2005 | Morita | 365/203 |
| 2005/0264499 | A1* | 12/2005 | Kim et al. | 345/76 |
| 2006/0038754 | A1* | 2/2006 | Kim | 345/76 |
| 2006/0139343 | A1* | 6/2006 | Choi et al. | 345/204 |
| 2007/0024541 | A1* | 2/2007 | Ryu et al. | 345/76 |
| 2007/0200814 | A1* | 8/2007 | Kwon | 345/92 |
| 2008/0174574 | A1* | 7/2008 | Yoo | 345/204 |

FOREIGN PATENT DOCUMENTS

| | | | |
|---|---|---|---|
| JP | 2005-164634 | A | 6/2005 |
| KR | 10-2006-0030682 | A | 4/2006 |
| KR | 10-0578788 | B1 | 5/2006 |
| KR | 10-2007-0002155 | A | 1/2007 |
| KR | 10-2007-0015829 | A | 2/2007 |
| KR | 10-0719662 | B1 | 5/2007 |
| KR | 10-0732853 | B1 | 6/2007 |

OTHER PUBLICATIONS

Korean Office Action dated Jul. 28, 2009 for Korean Patent Application No. KR 10-2007-0120017 which corresponds to captioned U.S. Appl. No. 12/217,665.

* cited by examiner

*Primary Examiner* — Chanh Nguyen
*Assistant Examiner* — Navin Lingaraju
(74) *Attorney, Agent, or Firm* — Knobbe Martens Olson & Bear LLP

(57) ABSTRACT

A pixel circuit for an organic light emitting display is disclosed. The pixel uses both current and voltage driving methods. A voltage based on an input current and on an input voltage is stored, and current for an organic light emitting diode is generated based on the stored current.

10 Claims, 7 Drawing Sheets

ORGANIC LIGHT EMITTING DISPLAY COMPRISING A SINK CURRENT GENERATOR THAT GENERATES AN INITIALIZATION CURRENT CORRESPONDING TO BIT VALUES OF INITIALIZATION DATA

CROSS-REFERENCE TO RELATED APPLICATIONS

This application claims priority to and the benefit of Korean Patent Application No. 10-2007-0120017, filed on Nov. 23, 2007, in the Korean Intellectual Property Office, the entire content of which is incorporated herein by reference.

BACKGROUND

1. Field

The field relates to an organic light emitting display, and more particularly to an organic light emitting display capable of displaying an image of uniform brightness and of realizing a high resolution and large area display.

2. Description of the Related Technology

An organic light emitting display displays an image using an organic light emitting diode (OLED) that generates light by re-combination of electrons and holes. The organic light emitting display has high response speed and is driven by low power consumption.

Methods of driving the organic light emitting display include a voltage driving method and a current driving method.

In the voltage driving method, a data signal voltage takes on one of a plurality gray scale voltage values and is supplied to pixels to display an image.

In some voltage driving methods, due to the characteristic variation of the driving transistors included in the pixels, the image may not be uniformly displayed.

In the current driving method, a current as a data signal is supplied to the pixels to display an image. In the current driving method, since current is used, an image can be uniformly displayed regardless of the characteristic variation of the driving transistors.

However, in some current driving methods, because a small current is used as the data signal, it is not possible to charge the desired voltage in the pixels within a short time. When the small current is used as the data signal, a large amount of time is required for charging the pixels due to load capacitance included in each of data lines. Therefore, it is difficult to apply some current driving methods to a large area display.

In addition, in some current driving methods, since a plurality of gray scales are displayed using the small current, it can be very difficult to design a data driver. Actually, since it may be very difficult to design a data driver that produces a high definition output, it may also be difficult to transmit a low gray scale data signal to the pixels. Therefore, some current driving methods may be difficult to apply to a high resolution display.

SUMMARY OF CERTAIN INVENTIVE ASPECTS

One aspect is an organic light emitting display. The display includes a pixel unit having a plurality of pixels formed in regions defined by scan lines, emission control lines, data lines, and current sink lines on which compensation current is sunk. The display also has a data driver configured to sink the compensation current from the pixels through the current sink lines and to supply data voltages to the data lines, where the data driver includes a sink current generator including a digital to analog converting unit configured to generate the compensation current to correspond to bit values of initial data, and a data voltage generator configured to generate the data voltages.

Another aspect is an organic light emitting display, including a pixel unit with a plurality of pixels, each pixel including a voltage input configured to receive an input voltage, a current input configured to receive an input current, a current generator, configured to generate current based on the input voltage and on the input current, and an organic light emitting diode configured to emit light based on the generated current.

BRIEF DESCRIPTION OF THE DRAWINGS

These and/or other embodiments and features of the invention will become apparent and more readily appreciated from the following description of certain exemplary embodiments, taken in conjunction with the accompanying drawings of which.

DETAILED DESCRIPTION OF CERTAIN INVENTIVE EMBODIMENTS

Figure 1:
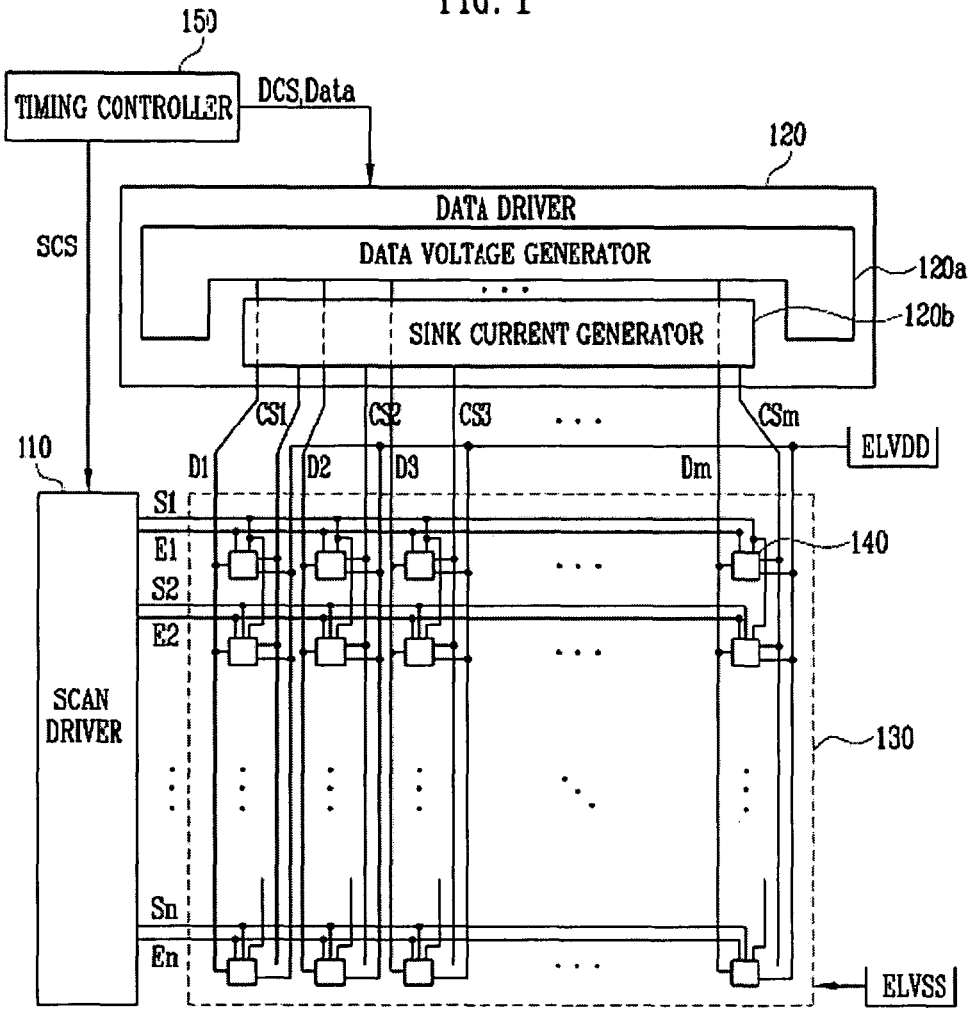
FIG. 1 is a block diagram of an organic light emitting display according to an embodiment.

Hereinafter, certain exemplary embodiments will be described with reference to the accompanying drawings. Here, when a first element is described as being coupled to a second element, the first element may be not only directly coupled to the second element but may also be indirectly coupled to the second element via a third element. Further, elements that are not essential to the complete understanding of the invention may be omitted for clarity. Also, like reference numerals generally refer to like elements throughout.

FIG. 1 is a block diagram of an organic light emitting display according to an embodiment.

Referring to FIG. 1, an organic light emitting display includes a pixel unit 130, a scan driver 110, a data driver 120, and a timing controller 150.

The pixel unit 130 includes a plurality of pixels 140 formed in regions defined by scan lines S1 to Sn, emission control lines E1 to En, data lines D1 to Dm, and current sink lines CS1 to CSm.

Here, the scan lines S1 to Sn, the emission control lines E1 to En, and the data lines D1 to Dm receive scan signals, emission control signals, and data voltages, respectively. Each current sink line CS1 to CSm provides a current path on which sink current (compensation current) generated by the data driver 120 is sunk. The pixel unit 130 transmits first and second pixel power sources ELVDD and ELVSS to the pixels 140, respectively.

The pixels 140 charge a voltage corresponding to current through the current sink lines CS1 to CSm. At this time, the voltage charged in the pixels 140 is determined by the sunk current regardless of the characteristics (for example, mobility and/or a threshold voltage) of the driving transistors included in the pixels 140, respectively. Therefore, the voltage that can compensate for the characteristic variation of the driving transistors in this period is charged in the pixels 140.

For example, the pixels 140 can store the voltage corresponding to current through the current sink lines CS1 to CSm while a scan signal is supplied to a previous scan line S. Accordingly, when the pixels 140 are coupled with an (i−1)th scan line Si−1 and an ith scan line Si, the (i−1)th scan line Si−1 is the previous scan line.

Then, the pixels 140 can additionally store voltages corresponding to the data voltages when the data voltages (that is, data voltage signals) are supplied from the data lines D1 to Dm.

For example, the pixels 140 can store voltages corresponding to the data voltages supplied from the data lines D1 to Dm while a scan signal is supplied to the current scan line S.

As a result, the pixels 140 supply currents from a first pixel power source ELVDD to a second pixel power source ELVSS via an organic light emitting diode (OLED) (not shown), where the current corresponds to both the current in the sink lines CS1 to CSm and to the data voltages supplied from the data lines D1 to Dm.

For example, the pixels 140 can supply currents corresponding to both stored voltages to the OLED when the emission control signals are not supplied (that is, emission control signals in a low level are supplied). As a result, the OLED emits light with brightness corresponding to current supplied thereto so that the pixel unit 130 displays an image.

The detailed structure of the pixels 140 will be described later.

On the other hand, although not shown in FIG. 1, a $0^{th}$ scan line S0 may be additionally formed on a first scan line S1 so that the $0^{th}$ scan line S0 can be coupled with the pixels 140 positioned on a first horizontal line. Therefore, the pixels 140 positioned on the first horizontal line can be stably driven.

The scan driver 110 sequentially supplies the scan signals and the emission control signals to the scan lines S1 to Sn and the emission control lines E1 to En in response to scan driving control signals SCS supplied thereto. Here, emission control signals (in a high level) prevent current from being supplied to the OLED while current is sunk by the pixels 140 or while the data voltages are supplied to the pixels 140. Therefore, the emission control signals are supplied to overlap at least two scan signals. For example, an emission control signal supplied to an ith (i is a natural number) emission control line Ei can be supplied to overlap the scan signals supplied to the (i−1)th scan line Si−1 and the ith scan line Si.

The data driver 120 sinks current from the pixels 140 (that is, the pixels 140 of a next horizontal line) selected by the scan signals via the current sink lines CS1 to CSm in a first period where the scan signal is supplied to the previous scan line S in response to a data driving control signal DCS supplied thereto. Therefore, the characteristic variation of the driving transistors is compensated for in the pixels 140 by which the current is sunk. For this, the data driver 120 includes a sink current generator 120*b* for generating sink current (compensation current) sunk in the first period. The sink current generator 120*b* is electrically coupled with the current sink lines CS1 to CSm to sink current from the pixels 140 through the current sink lines CS1 to CSm.

The current can, for example, be the minimum current value that can be transmitted from the data driver 120 to the pixels 140 within an assigned time or a value no less than the minimum current value when specific current is transmitted to the pixels 140.

That is, the current is set as a current value that can sufficiently charge the load capacitance of each of the current sink lines CS1 to CSm while the scan signal is supplied to the previous scan line S.

For example, the current can be equal to or larger than current that flows to the OLED when each of the pixels 140 maximally emits light. In some embodiments, the sunk current can be determined in consideration of the size of a panel, the width of the current sink lines CS1 to CSm, and resolution of the display.

In some embodiments, the value of the current is one value or at least two values to be variously applied. For example, the current can change in accordance with the deterioration of the pixels 140. However, since gray scales are not displayed by the sunk current, the number of sunk currents can be minimized. Therefore, since the sink current generator 120*b* needs not produce a high precision output, there are fewer constraints in designing the sink current generator 120*b*.

In addition, the data driver 120 generates the data signals, that is, the data voltages in response to the data driving control signals DCS and data Data that are supplied thereto. Then, in a second period subsequent to the first period, that is, in a period where the scan signal is supplied to the current scan line S, the data driver 120 supplies the data voltages to the data lines D1 to Dm. Therefore, the data voltages are supplied to the pixels 140 selected by the scan signal supplied to the current scan line S.

For this, the data driver 120 further includes a data voltage generator 120*a* for generating the data voltages supplied in the second period. The data voltage generator 120*a* is electrically coupled with the data lines D1 to Dm to supply the data voltages to the data lines D1 to Dm. The data voltages corresponding to the gray scales to be displayed operate as the data signals. The data voltages-supplied to the data lines D1 to Dm are supplied to the pixels 140 synchronously with the scan signals.

The timing controller 150 generates the data driving control signals DCS and the scan driving control signals SCS in response to received synchronizing signals. The data driving controls signals DCS generated by the timing controller 150 are supplied to the data driver 120 and the scan driving controls signals SCS are supplied to the scan driver 110. In addition, the timing controller 150 may also re-align the data Data supplied from the outside to supply the data Data to the data driver 120.

The data driver 120 including the sink current generator 120*b* and the data voltage generator 120*a* allows for the organic light emitting display to be driven with both a current driving method and a voltage driving method.

That is, after the characteristic variation of the driving transistors is compensated for using the current driving method, the data voltages can be rapidly charged in the pixels 140 using the voltage driving method. Therefore, it is possible to display an image with uniform brightness and to realize a high resolution and large organic light emitting display.

Figure 2:
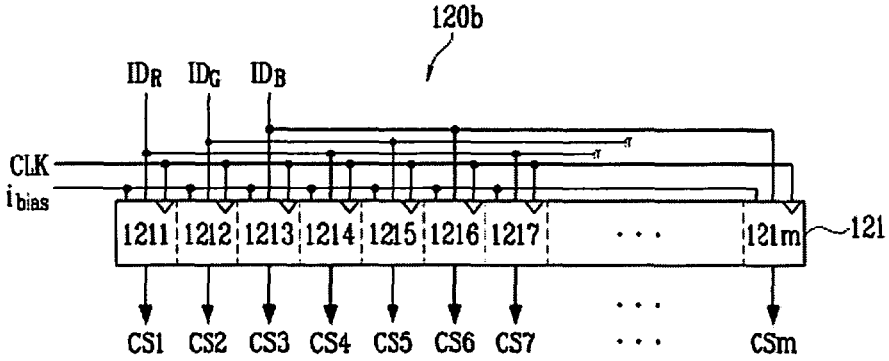
FIG. 2 is a block diagram of the sink current generator illustrated in FIG. 1 according to an example.

FIG. 2 is a block diagram of the sink current generator illustrated in FIG. 1 according to one example.

Referring to FIG. 2, the sink current generator 120*b* includes a digital-analog converting unit 121 for generating sink current (compensation current) corresponding to the bits values $ID_R$, $ID_G$, and $ID_B$ of the R, G, and B initial data, supplied, for example, from the outside by a timing controller.

The digital-analog converting unit 121 generates sink current in response to the bit values $ID_R$, $ID_G$, and $ID_B$ of R, G, and B initial data, clock signals CLK, and bias current $i_{bias}$ supplied, for example, from the outside. For this, the digital-analog converting unit 121 includes m digital-analog converters DAC 1211 to 121*m* positioned in channels, respectively. The sink current generated by the digital-analog converting unit 121 is supplied to the current sink lines CS1 to CSm.

On the other hand, the bit values $ID_R$, $ID_G$, and $ID_B$ of the R, G, and B initial data for generating the sink current can be set as one value or at least one value.

For example, the bit values $ID_R$, $ID_G$, and $ID_B$ of the R, G, and B initial data can be set as at least two values by R, G, and B. In this case, the bit values $ID_R$, $ID_G$, and $ID_B$ of the R, G, and B initial data are selected in accordance with the deterioration of the pixels to generate the sink current corresponding thereto.

On the other hand, in FIG. 2, the sink current generator 120*b* including the m DACs 1211 to 121*m* positioned in the channels, respectively, is illustrated. However, the present invention is not limited thereto. For example, in some embodiments, a plurality of channels can share one DAC.

Figure 3:
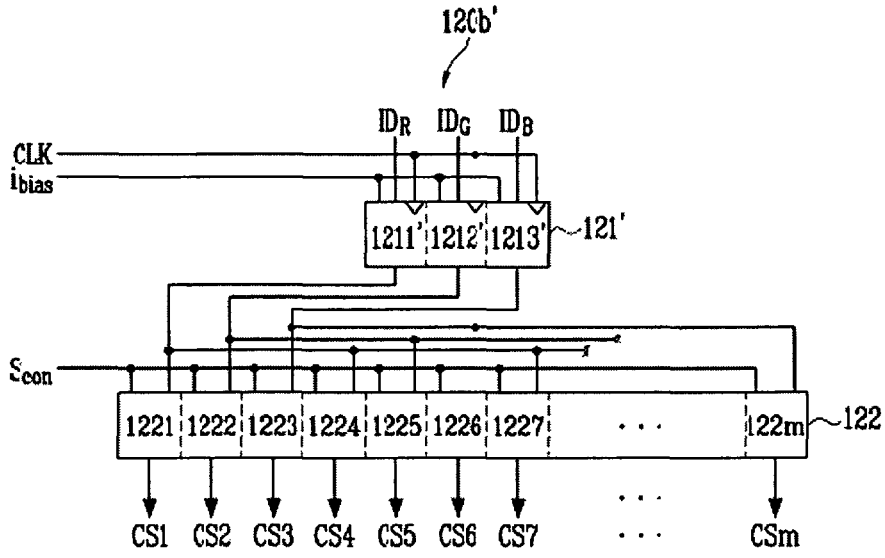
FIG. 3 is a block diagram of the sink current generator illustrated in FIG. 1 according to another example.

FIG. 3 is a block diagram of the sink current generator illustrated in FIG. 1 according to another example.

Referring to FIG. 3, a sink current generator 120*b*' can include a digital-analog converting unit 121' including DACs 1211' to 1213' by R, G, and B. In this case, a current stage 122 for storing a value representing sink current supplied from the DAC 121' can be further included in the output lines of the DAC 121'.

The current stage unit 122 temporarily stores the sink current supplied from the digital to analog converting unit 121' to output the sink current to the current sink lines CS1 to CSm in response to a control signal Scon supplied, for example, from the outside. For this, the current stage unit 122 includes current stages 1221 to 122*m* provided in the channels, respectively.

As described above, when the DACs 1211' to 1213' are provided by R, G, and B, the bit values of the R, G, and B initial data $ID_R$, $ID_G$, and $ID_B$ are converted by the DACs 1211' to 1213', respectively. The converted analog values are output to the current stages 1221 to 122*m* formed in the m channels.

As described above, when the DACs 1211' to 1213' are provided by R, G, and B, higher precision is possible.

With reference to FIGS. 2 and 3, the sink current generators 120*b* and 120*b*' for generating the sink currents corresponding to the bit values $ID_R$, $ID_G$, and $ID_B$ of the R, G, and B initial data are described above. However, the present invention is not limited to the above. For example, a fixed current source can be provided in the data driver 120.

Figure 4:
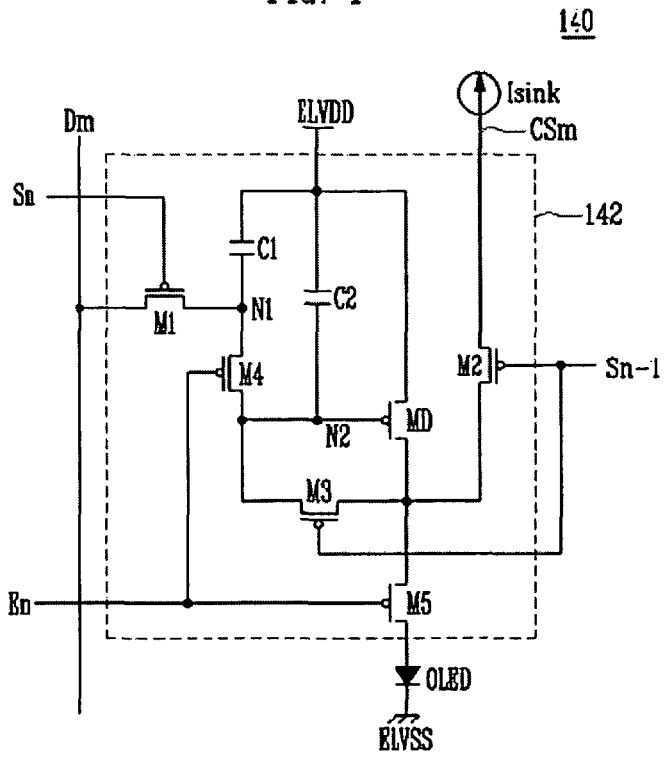
FIG. 4 is a circuit diagram of the pixels illustrated in FIG. 1 according to one embodiment.

FIG. 4 is a circuit diagram of the pixels illustrated in FIG. 1 according to a first embodiment. For convenience sake, in FIG. 4, pixels positioned in an nth horizontal line and an mth vertical line are illustrated.

Referring to FIG. 4, the pixel 140 according to this embodiment includes an OLED and a pixel circuit 142 for supplying current to the OLED.

The OLED emits light of a certain color in response to current supplied from the pixel circuit 142. For example, the OLED can emit light of one of red light, green light, and blue light with brightness corresponding to current supplied thereto. The pixel circuit 142 firstly charges a voltage that can compensate for the variation in current parameters of the driving transistors MD when a scan signal is supplied to an (n−1)th scan line Sn−1 (a previous scan line). Then, the pixel circuit 142 secondly charges the voltages corresponding to the data voltages (the data signals) when a scan signal is supplied to an nth scan line Sn (the current scan line). Then, the pixel circuit 142 converts the firstly charged voltage and the secondly charged voltage into a combined voltage when an emission control signal is not supplied to an nth emission control line En (that is, when the emission control signal is in a low level). Then, the pixel circuit 142 supplies current corresponding to the combined voltage to the OLED.

For this, the pixel circuit 142 includes a driving transistor MD, first to fifth transistors M1 to M5, and first and second capacitors C1 and C2.

The first transistor M1 is coupled between the data line Dm and a first node N1 and the gate electrode of the first transistor M1 is connected to the nth scan line Sn. The first transistor M1 is turned on when a scan signal is supplied to the nth scan line Sn to transmit a data voltage supplied from the data line Dm to the first node N1.

The transistor M2 is coupled between the current sink line CSm and the second electrode (for example, the drain electrode) of the driving transistor MD and the gate electrode of the second transistor M2 is coupled with the (n−1)th scan line Sn−1. The second transistor M2 is turned on when a scan signal is supplied to the (n−1)th scan line Sn−1 to electrically couple the current sink line CSm with the second electrode of the driving transistor MD.

The third transistor M3 is coupled between the gate electrode and the second electrode of the driving transistor MD and the gate electrode of the third transistor M3 is coupled with the (n−1)th scan line Sn−1. The third transistor M3 is turned on when the scan signal is supplied to the (n−1)th scan line Sn−1 to diode couple the driving transistor MD.

The fourth transistor M4 is coupled between the first node N1 and a second node N2 and the gate electrode of the fourth transistor M4 is coupled with the emission control line En. The fourth transistor M4 is turned off when an emission control signal (in a high level) is supplied to the emission control line En and is turned on when the emission control line is in a low level. The fourth transistor M4 is turned on to electrically couple the first node N1 with the second node N2.

The fifth transistor M5 is coupled between the driving transistor MD and the OLED so that the gate electrode of the fifth transistor M5 is coupled with the emission control line En. The fifth transistor M5 is turned off when the emission control signal is supplied to the emission control line En and is turned on otherwise. That is, the fifth transistor M5 is turned on in a period where the emission control signal is low to transmit current supplied from the driving transistor MD to the OLED.

The driving transistor MD is coupled between the first pixel power source ELVDD and the fifth transistor M5 and the gate electrode of the driving transistor MD is coupled with the second node N2. The driving transistor MD supplies current corresponding to a voltage applied to the second node N2 from the first pixel power source ELVDD to the second pixel power source ELVSS via the fifth transistor M5 and the OLED.

The first capacitor C1 is coupled between the first pixel power source ELVDD and the first node N1. The first capacitor C1 stores a voltage corresponding to a data voltage supplied to the first node N1.

The second capacitor C2 is coupled between the first pixel power source ELVDD and the second node N2. The second capacitor C2 stores a voltage corresponding thereto when predetermined current is sunken through the current sink line CSm.

Figure 5:
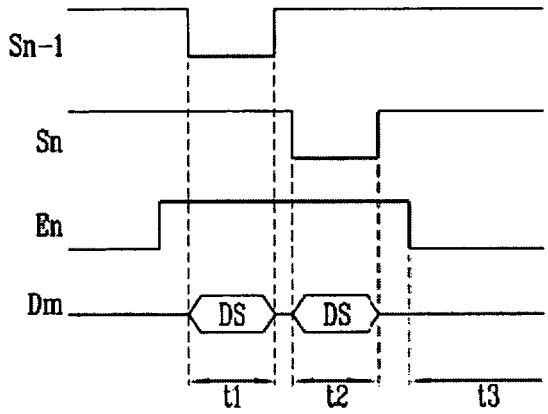
FIG. 5 illustrates waveforms describing a method of driving the pixels according to an embodiment.

FIG. 5 illustrates waveforms describing a method of driving the pixels according to an embodiment of the present invention.

Hereinafter, a method of driving the pixel 140 illustrated in FIG. 4 will be described with reference to FIGS. 4 and 5.

First, when an emission control signal (in a high level) is supplied to the emission control line En, the fourth and fifth transistors M4 and M5 are turned off.

Then, in a first period t1, a scan signal (in a low level) is supplied to the (n−1)th the scan line Sn−1, the second and third transistors M2 and M3 are turned on. When the second transistor M2 is turned on, the current sink line CSm is electrically coupled with the second electrode of the driving transistor MD. The third transistor M3 is also turned on, so that the driving transistor MD is diode coupled. Because the current sink line CSm is coupled with the sink current generator of the data driver, sink current is supplied to the current sink line CSm. In FIG. 4, the sink current is illustrated as a current source.

In the first period t1, a current is sunk from the first pixel power source ELVDD to the current sink line CSm via the driving transistor MD and the second transistor M2.

The second node N2 is applied with a voltage corresponding to the current that flows to the driving transistor MD. Therefore, the second capacitor C2 is charged with a voltage corresponding to the voltage applied in the second node N2.

The voltage applied in the second node N2 is determined by the current that flows to the driving transistor MD, and is not affected by characteristic variation of the driving transistor MD.

Since current that flows to the driving transistor MD in the first period t1 is the same in each of the pixels 140, the voltage that compensates for characteristic variation of the driving transistor MD such as mobility and the threshold voltage are applied to the second node N2.

Also, since a scan signal is not supplied to the nth scan line Sn in the first period t1, the first transistor M1 is maintained to be turned off. Therefore, the data voltage DS supplied to the data line Dm is not supplied to the pixel 140 positioned in an nth horizontal line. That is, the data voltage DS supplied in the first period t1 is supplied to only a pixel positioned in an (n−1)th horizontal line.

Then, the scan signal (in the low level) is supplied to the nth scan line Sn in the second period t2, the first transistor M1 is turned on. When the first transistor M1 is turned on, the data voltage DS supplied to the data line Dm is transmitted to the first node N1. Then, a voltage corresponding to the data voltage DS is charged in the first capacitor C1.

Then, when the supply of the emission control signal (in a high level) to the emission control line En is stopped (that is, when the emission control signal is changed to a low level) in the third period t3, the fourth and fifth transistors M4 and M5 are turned on.

When the fourth transistor M4 is turned on, the first node N1 is electrically coupled with the second node N2. When the first node N1 is electrically coupled with the second node N2, a voltage charged in the first capacitor C1 and a voltage charged in the second capacitor C2 are distributed to be converted into one voltage and are applied to the first node N1 and the second node N2. At this time, the voltage applied to the second node N2 is a voltage that both compensates for the characteristic variation of the driving transistor MD and that corresponds to the data voltage DS.

The voltage applied to the second node N2 is affected by the capacitances of the first capacitor C1 and the second capacitor C2. Therefore, the capacitances of the first capacitor C1 and the second capacitor C2 can be determined so that a desired voltage is applied to the second node N2.

In the third period t3, the driving transistor MD supplies current corresponding to the voltage applied to the second node N2 from the first pixel power source ELVDD to the fifth transistor M5.

At this time, since the fifth transistor M5 is turned on, the current supplied from the driving transistor MD flows to the second pixel power source ELVSS via the fifth transistor M5 and the OLED.

That is, in the third period t3, a current path is formed from the first pixel power source ELVDD to the second pixel power source ELVSS via the driving transistor MD, the fifth transistor M5, and the OLED. At this time, the OLED emits light with brightness corresponding to current that flows therethrough.

As described above, current is sunk in a period where the scan signal is supplied to the previous scan line Sn−1 to compensate for the characteristic variation of the driving transistor MD and the data voltage DS is charged in a period where the scan signal is supplied to the current scan line Sn. Then, the voltage that compensates for the characteristic variation of the driving transistor MD and the data voltage DS are converted into a combined voltage and is used to drive the driving transistor MD during the third period t3.

That is, after the voltage which compensates for the characteristic variation of the driving transistor MD is stored, the data voltage DS can be rapidly charged in the pixel 140 using the voltage driving method. Therefore, it is possible to display an image with uniform brightness and to realize a high resolution and large organic light emitting display.

Figure 6:
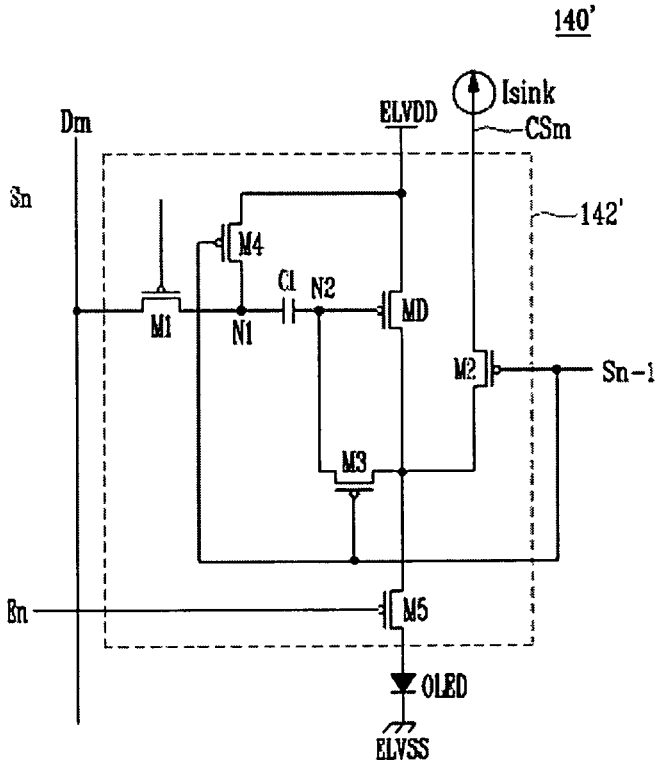
FIG. 6 is a circuit diagram of the pixels illustrated in FIG. 1 according to another embodiment.

FIG. 6 is a circuit diagram of the pixels illustrated in FIG. 1 according to another embodiment.

In FIG. 6, detailed description of the same parts as the parts of FIG. 4 will generally be omitted.

Referring to FIG. 6, in a pixel circuit 142' of a pixel 140' the fourth transistor M4 is coupled between the first pixel power source ELVDD and the first node N1, and the gate electrode of the fourth transistor M4 is coupled with the (n−1)th scan line Sn−1

In addition, one capacitor (the first capacitor C1) is coupled between the first node N1 and the second node N2. Here, the first node N1 is coupled with the second electrode (for example, the drain electrode) of the first transistor M1 and the second node N2 is coupled with the gate electrode of the driving transistor MD.

The pixel 140' according to the second embodiment can be driven by the waveforms illustrated in FIG. 5.

Hereinafter, a method of driving the pixel 140' illustrated in FIG. 6 will be described in detail with reference to FIGS. 5 and 6.

When the emission control signal is in a high level, the fifth transistor M5 is turned off.

Then, when the scan signal is in a low level on the (n−1)th scan line Sn−1 in the first period t1, the second, third, and fourth transistors M2, M3, and M4 are turned on.

When the second transistor M2 is turned on, the current sink line CSm is electrically coupled with the second electrode of the driving transistor MD. Then, when the third transistor M3 is turned on, the driving transistor MD is diode coupled. Therefore, current is sunk from the first pixel power source ELVDD to the current sink line CSm via the driving transistor MD and the second transistor M2. Therefore, the voltage that can compensate for the characteristic variation of the driving transistor MD is applied to the second node N2.

When the fourth transistor M4 is turned on, the first pixel power source ELVDD is applied to the first node N1. Therefore, a voltage corresponding to a difference in a voltage applied to the first node N1 and a voltage applied to the second node N2 is charged in the first capacitor C1.

FIG. 6, the fourth transistor M4 is coupled with the first pixel power source ELVDD. However, the present invention is not limited to the above. For example, an optional power source determined by a designer can be coupled with the first electrode (for example, the source electrode) of the fourth transistor M4. That is, the voltage applied to the first node N1 in the first period t1 can vary in accordance with a design.

The supply of the scan signal to the (n−1)th scan line Sn−1 is stopped in the second period t2 and the scan signal (in a low level) is supplied to the nth scan line Sn. Then, the second to fourth transistors M2 to M4 are turned off and the first transistor M1 is turned on.

When the first transistor M1 is turned on, the data voltage DS supplied to the data line Dm is transmitted to the first node N1. Then, because the voltage of the first node N1 changes, the voltage of the second node N2 also changes by the coupling operation of the first capacitor C1. At this time, the first capacitor C1 performs a coupling operation to correspond to a change in the voltage of the first node N1. Therefore, the voltage applied to the second node N2 is determined as the voltage that can compensate for the characteristic variation of the driving transistor MD as well as the voltage corresponding to the data voltage DS.

Then, when the supply of the emission control signal (in a high level) to the emission control line En is stopped in the third period t3 (that is, when the emission control signal is transmitted to a low level), the fifth transistor M5 is turned on.

Accordingly, the driving transistor MD supplies the current corresponding to the voltage applied to the second node N2 from the first pixel power source ELVDD to the fifth transistor M5.

Therefore, current supplied from the driving transistor MD flows to the second pixel power source ELVSS via the fifth transistor M5 and the OLED.

That is, in the third period t3, a current path is formed from the first pixel power source ELVDD to the second pixel power source ELVSS via the driving transistor MD, the fifth transistor M5, and the OLED. In response, the OLED emits light with brightness corresponding to current that flows therethrough.

In the embodiment of FIG. 6, both a current driving method and a voltage driving method are combined to drive the pixel 140'. Therefore, an image with uniform brightness is displayed with high resolution in a large organic light emitting display.

Figure 7:
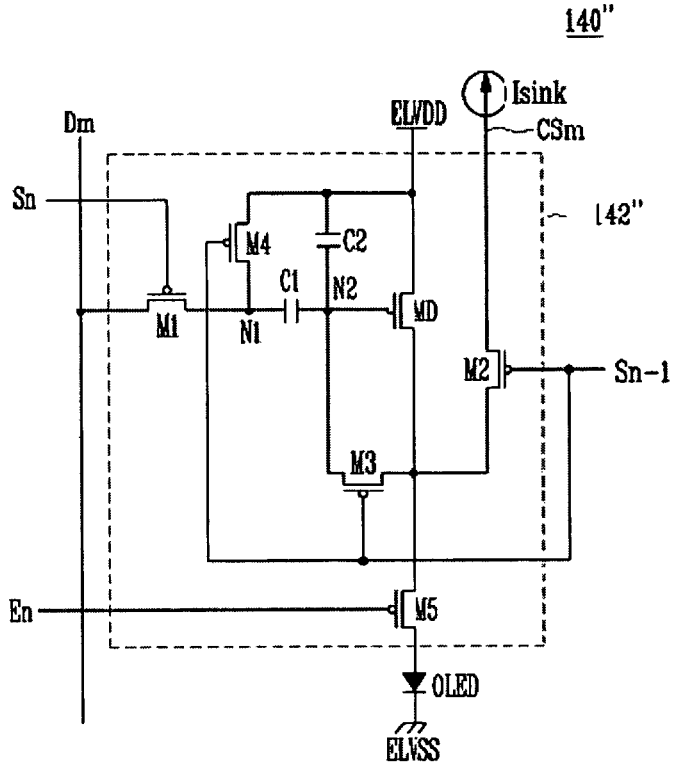
FIG. 7 is a circuit diagram of the pixels illustrated in FIG. 1 according to another embodiment.

FIG. 7 is a circuit diagram of the pixels illustrated in FIG. 1 according to another embodiment.

The pixel illustrated in FIG. 7 is includes a second capacitor C2. Regarding the pixel of FIG. 7, detailed description of some corresponding parts to the parts of FIG. 6 will be omitted.

Referring to FIG. 7, the second capacitor C2 is coupled between the second node N2 of a pixel circuit 142" and the first pixel power source ELVDD.

As described above, the second capacitor C2 is added so that the voltage of the second node N2 is determined by the capacitance ratio of the first and second capacitors C1 and C2 in the second period t2 illustrated in FIG. 5.

Therefore, the capacitances of the first capacitor C1 and the second capacitor C2 can be determined such that a desired voltage is applied to the second node N2.

Since the remaining operation of the pixel 140" of FIG. 7 is similar to the operation of the pixel 140' of FIG. 6, further description thereof will be omitted.

Figure 8:
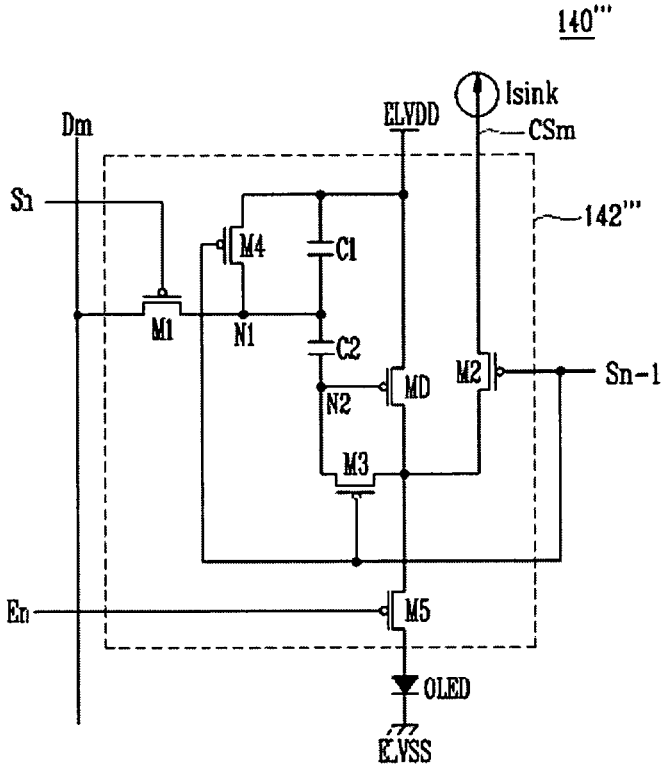
FIG. 8 is a circuit diagram of the pixels illustrated in FIG. 1 according to another embodiment.

FIG. 8 is a circuit diagram of the pixels illustrated in FIG. 1 according to another embodiment. In FIG. 8, detailed description of some corresponding parts to the parts of FIG. 4 will be omitted.

Referring to FIG. 8, in a pixel circuit 142'" of a pixel 140'" the fourth transistor M4 is coupled between the first pixel power source ELVDD and the first node N1. And, the gate electrode of the fourth transistor M4 is coupled with the (n−1)th scan line Sn−1.

In addition, the first capacitor C1 is coupled between the first pixel power source ELVDD and the first node N1 and the second capacitor C2 is coupled between the first node N1 and the second node N2. Here, the first node N1 is coupled with the second electrode (for example, the drain electrode) of the first transistor M1. The second node N2 is coupled with the gate electrode of the driving transistor MD.

The pixel 140'" can be driven by the waveforms illustrated in FIG. 5.

A method of driving the pixel 140'" illustrated in FIG. 8 will be described with reference to FIGS. 5 and 8.

First, when the emission control signal is in a high level, the fifth transistor M5 is turned off.

Then, the scan signal (in a low level) is supplied to the (n−1)th scan line Sn−1 in the first period t1, so that the second, third, and fourth transistors M2, M3, and M4 are turned on.

When the second transistor M2 is turned on, the current sink line CSm is electrically coupled with the second electrode of the driving transistor MD. And, when the third transistor M3 is turned on, the driving transistor MD is diode coupled. Therefore, current is sunk from the first pixel power source ELVDD to the current sink line CSm via the driving transistor MD and the second transistor M2. Therefore, the voltage that compensates for the characteristic variation of the driving transistor MD is applied to the second node N2.

When the fourth transistor M4 is turned on, the first pixel power source ELVDD is applied to the first node N1. Therefore, the voltage corresponding to a difference between the voltage applied to the first node N1 and the voltage applied to the second node N2 is charged in the second capacitor C2.

Here, in FIG. 8, the fourth transistor M4 is coupled with the first pixel power source ELVDD. However, the present invention is not limited to the above. For example, an optional power source determined by a designer can be coupled with the first electrode (for example, the source electrode) of the fourth transistor M4. That is, the voltage applied to the first node N1 in the first period t1 can vary in accordance with a design.

Then, the supply of the scan signal to the (n−1)th scan line Sn−1 is stopped in the second period t2 and the scan signal (in a low level) is supplied to the nth scan line Sn. Then, the second to fourth transistors M2 to M4 are turned off and the first transistor M1 is turned on.

When the first transistor M1 is turned on, the data voltage DS supplied to the data line Dm is transmitted to the first node N1. Then, the voltage of the first node N1 changes so that the voltage of the second node N2 changes because of the capacitive coupling of the second capacitor C2.

At this time, the second capacitor C2 performs a coupling operation to correspond to a change in the voltage of the first node N1. Therefore, the voltage applied to the second node N2 is a combination of the voltage that can compensate for the characteristic variation of the driving transistor MD and the voltage corresponding to the data voltage DS.

In addition, the voltage applied to the second node N2 is determined by the capacitance ratio of the first and second capacitors C1 and C2. Therefore, the capacitances of the first capacitor C1 and the second capacitor C2 can be determined so that a desired voltage is applied to the second node N2.

Then, the emission control signal is changed to a low level in the third period t3, and, as a result, the fifth transistor M5 is turned on.

The driving transistor MD then supplies current corresponding to the voltage applied to the second node N2 from the first pixel power source ELVDD to the fifth transistor M5.

Therefore, the current supplied from the driving transistor MD flows to the second pixel power source ELVSS via the fifth transistor M5 and the OLED.

That is, in the third period t3, a current path is formed from the first pixel power source ELVDD to the second pixel power source ELVSS via the driving transistor MD, the fifth transistor M5, and the OLED. At this time, the OLED emits light with brightness corresponding to current that flows therethrough.

In the above-described embodiment of FIG. 8, both a current driving method and a voltage driving method are combined to drive the pixel 140'''. Therefore, it is possible to display an image with uniform brightness and to realize a high resolution and large organic light emitting display.

Figure 9:
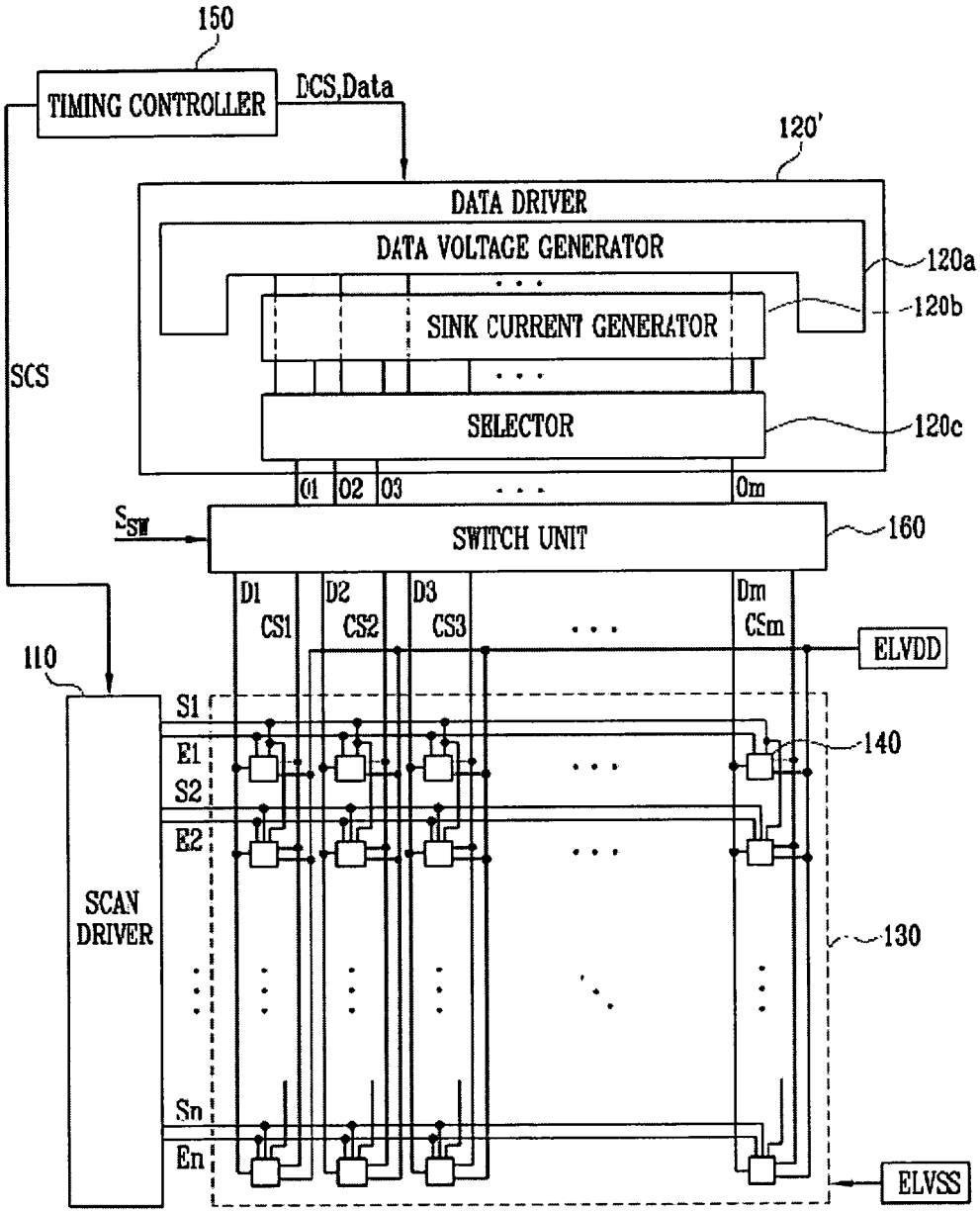
FIG. 9 is a block diagram of an organic light emitting display according to another embodiment.
Figure 10:
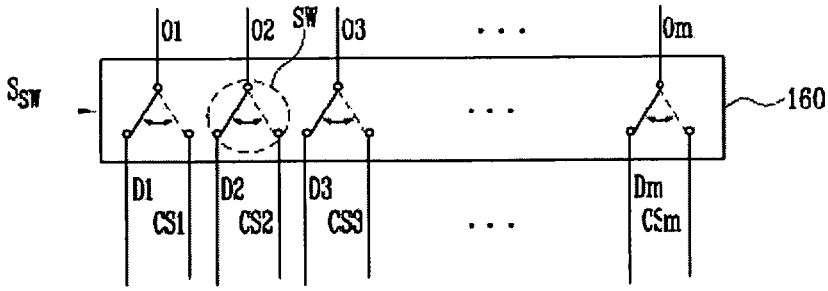
FIG. 10 is a schematic illustrating the structure of the switch unit illustrated in FIG. 9.

FIG. 9 is a block diagram of an organic light emitting display according to another embodiment. FIG. 10 schematically illustrates the structure of an embodiment of the switch unit illustrated in FIG. 9.

Referring to FIGS. 9 and 10, a data driver 120' further includes a selector 120*c* coupled with the output lines of the data voltage generator 120*a* and the sink current generator 120*b*. A switch unit 160 is coupled between the selector 120*c* and the pixel unit 130.

The selector 120*c* selects one of a data voltage supplied from the data voltage generator 120*a* and sink current (compensation current) supplied from the sink current generator 120*b*. For this, the selector 120*c* can receive control signals from the outside. For example, the control signals are included in the data driving control signals DCS to be supplied from the timing controller 150 to the selector 120*c*. The data voltage or the sink current selected by the selector 120*c* is output to output lines O1 to Om.

The selector 120*c* can include a buffer (not shown) for temporarily storing the data voltage supplied from the data voltage generator 120*a*.

As illustrated in FIG. 10, the switch unit 160 includes a plurality of switches SW coupled with the output lines O1 to Om of the data driver 120'. The switches SW alternately couple the output lines O1 to Om of the data driver 120' with the data lines D1 to Dm or the output lines O1 to Om of the data driver 120' with the current sink lines CS1 to CSm.

In this embodiment, a switching signal Ssw for controlling the switches SW is generated by the external circuit for example, the timing controller 150 to be supplied to the switch unit 160.

As described above, when the selector 120*c* is included, it is possible to reduce the number of output pins of the data driver 120'. Therefore, it is possible to improve the degree of freedom of a design.

As described above, the data driver comprising the sink current generator and the data voltage generator is provided to realize an organic light emitting display driven by a combination of a current driving method and a voltage driving method.

That is, in some embodiments, after the characteristic variation of the driving transistors is compensated using a current driving method, the data voltages can be rapidly charged in the pixels using a voltage driving method. However, the order of the application of the current and voltage driving method may be reversed. For example, in some embodiments, a voltage driving method is used and a result stored, after which a current driving method is used and a second result is stored. The results of both driving methods is then used to drive the OLED. Therefore, it is possible to display an image with uniform brightness and to realize a high resolution and large organic light emitting display.

Although exemplary embodiments have been shown and described, it would be appreciated by those skilled in the art that changes might be made in these embodiments without departing from the principles and spirit of the invention.\

What is claimed is:

1. An organic light emitting display, comprising:

a pixel unit comprising a plurality of pixels formed in regions defined by scan lines, emission control lines, data lines, and current sink lines, wherein each pixel comprises a pixel node configured both to be initialized by one of the current sink lines and to receive a data voltage from one of the data lines after being initialized, wherein an initialization current is sunk on the current sink lines to initialize the pixel node, and wherein the data voltage is received from the data lines to change the voltage of the pixel node from a voltage induced by the initialization current, and wherein the data lines and the current sink lines are separate; and a data driver configured to sink the initialization current from the pixels through the current sink lines and to supply data voltages to the data lines, wherein the data driver comprises:

a sink current generator including a digital to analog converting unit configured to generate the initialization current to correspond to bit values of initialization data; and a data voltage generator configured to generate the data voltages, wherein each of the pixels comprises:

an OLED coupled between a first pixel power source and a second pixel power source;

a driving transistor coupled between the first pixel power source and the OLED to supply current to the OLED in response to a voltage supplied to a gate electrode thereof;

a first transistor coupled between the data line and a first node to transmit the data voltage supplied to the data line to a first node in response to a scan signal supplied from a current scan line;

a second transistor coupled between a second electrode of the driving transistor and the current sink line to electrically couple the driving transistor with the current sink line in response to a scan signal supplied from a previous scan line;

a third transistor coupled between the second electrode of the driving transistor and a gate electrode of the driving transistor to diode couple the driving transistor in response to the scan signal supplied from the previous scan line; and a first capacitor coupled with the first node, wherein the first capacitor is coupled between the first node and the first pixel power source, and wherein each of the pixels further comprises:

a fourth transistor coupled between the first node and the gate electrode of the driving transistor to electrically couple the first node with the gate electrode of the driving transistor in response to an emission control signal supplied from the emission control line;

a second capacitor coupled between the first pixel power source and the gate electrode of the driving transistor; and a fifth transistor coupled between the driving transistor and the OLED to supply current supplied from the driving transistor to the OLED in response to the emission control signal.

2. The organic light emitting display as claimed in claim 1, wherein the bit values of the initial data for generating the initialization current have at least one value for each of red data, green data, and blue data.

3. The organic light emitting display as claimed in claim 2, wherein the bit values of the initial data have at least two values for each of the red data, the green data, and the blue data, and wherein one of the at least two values is selected to be used as a bit value for generating the initialization current.

4. The organic light emitting display as claimed in claim 1, wherein the digital to analog converting unit comprises first, second, and third digital to analog converters configured to respectively generate first, second, and third initialization currents corresponding to the red data, the green data, and the blue data, respectively.

5. The organic light emitting display as claimed in claim 4, wherein the sink current generator further comprises current stages for storing first, second, and third values representing the initialization currents supplied from the digital to analog converters.

6. The organic light emitting display as claimed in claim 4, wherein the digital to analog converters are provided in channels coupled with the current sink lines, respectively.

7. The organic light emitting display as claimed in claim 1, wherein the data driver further comprises a selector coupled with the data voltage generator and output lines of the sink current generator to selectively output the data voltages or the initialization current.

8. The organic light emitting display as claimed in claim 7, further comprising a switch unit coupled between the selector and the pixel unit to selectively supply the data voltages or the initialization current output from the selector to the data lines or the current sink lines.

9. The organic light emitting display as claimed in claim 1, wherein the initialization current is configured to charge the load capacitance of the current sink lines.

10. The organic light emitting display as claimed in claim 9, wherein the initialization current is equal to or higher than current supplied to organic light emitting diodes (OLED) included in each of the pixels when the pixels emit light with maximum brightness.

* * * * *